US011480405B2

(12) United States Patent
Bender

(10) Patent No.: US 11,480,405 B2
(45) Date of Patent: Oct. 25, 2022

(54) FIREARM TURBINE SUPPRESSOR

(71) Applicant: In Ovation LLC, Vadnais Heights, MN (US)

(72) Inventor: Terrence Dwight Bender, Minneapolis, MN (US)

(73) Assignee: In Ovation LLC, Vadnais Heights, MN (US)

( * ) Notice: Subject to any disclaimer, the term of this patent is extended or adjusted under 35 U.S.C. 154(b) by 748 days.

(21) Appl. No.: 16/168,743

(22) Filed: Oct. 23, 2018

(65) Prior Publication Data

US 2019/0120584 A1 Apr. 25, 2019

Related U.S. Application Data

(60) Provisional application No. 62/575,995, filed on Oct. 23, 2017.

(51) Int. Cl.
*F41A 21/30* (2006.01)
*F41A 21/32* (2006.01)

(52) U.S. Cl.
CPC ..... *F41A 21/30* (2013.01); *F41A 21/325* (2013.01)

(58) Field of Classification Search
CPC ..... F41A 21/30–38; F41A 13/10
USPC ..... 89/14.1–14.4; 181/223
See application file for complete search history.

(56) References Cited

U.S. PATENT DOCUMENTS 811,595 A * 2/1906 Taylor ..... F41A 13/10 89/14.3
1,242,890 A * 10/1917 Sheppard ..... F41A 13/12 415/72
1,413,903 A * 4/1922 Czegka ..... F41A 13/10 89/14.1
1,527,585 A * 2/1925 Hamilton ..... F41A 13/10 89/14.1
4,685,534 A * 8/1987 Burstein ..... F01N 1/00 181/223
7,854,297 B2 * 12/2010 Scanlon ..... F41A 21/30 181/250
8,522,662 B2 * 9/2013 Presz, Jr. ..... F41A 21/30 89/14.3

(Continued)

FOREIGN PATENT DOCUMENTS

DE 3430521 A1 * 2/1986 ..... F41A 13/10
GB 614464 A * 12/1948 ..... F01N 3/05

(Continued)

OTHER PUBLICATIONS

Warrior East 19—Mad Minute Suppressors, Jul. 15, 2019, Solider Systems, p. 1 (Year: 2019).*

*Primary Examiner* — Joshua E Freeman
*Assistant Examiner* — Benjamin S Gomberg
(74) *Attorney, Agent, or Firm* — Laabs Intellectual Property

(57) ABSTRACT

In some embodiments, a firearm suppressor comprises a body comprising a sidewall defining a cavity. In some embodiments, the body is configured for attachment to a firearm such that a muzzle of the firearm barrel is oriented in the cavity. In some embodiments, the suppressor comprises a rotating member oriented in the cavity, which is arranged to rotate with respect to the body. In some embodiments, the rotating member comprises a plurality of turbine blades and a central aperture.

20 Claims, 4 Drawing Sheets

(56) References Cited

U.S. PATENT DOCUMENTS

| | | | | |
|---|---|---|---|---|
| 8,695,475 | B2 * | 4/2014 | Schneider | F41A 21/36<br>89/14.3 |
| 9,739,296 | B2 * | 8/2017 | Schlosser | F02C 7/045 |
| 9,772,157 | B2 * | 9/2017 | Yoakam | F41A 21/28 |
| 11,118,857 | B2 * | 9/2021 | Griffin | F41A 21/36 |

FOREIGN PATENT DOCUMENTS

| | | | | |
|---|---|---|---|---|
| RU | 2646980 | C1 * | 3/2018 | F41A 13/10 |
| WO | WO-2016205838 | A1 * | 12/2016 | F41A 13/10 |

* cited by examiner

FIREARM TURBINE SUPPRESSOR

CROSS-REFERENCE TO RELATED APPLICATIONS

This application claims the benefit of U.S. Patent Application No. 62/575,995, filed Oct. 23, 2017, the entire content of which is hereby incorporated herein by reference.

BACKGROUND OF THE INVENTION

This invention relates to generally to firearms and firearm accessories, and more specifically to firearm suppressors.

Firearm suppressors are known in the art and are used to reduce the sound volume or report of a gunshot. Traditional suppressors are mounted on the end of a gun barrel, which can have multiple drawbacks. Suppressors often use internal baffling to direct hot propellant gasses that exit the barrel, leading to carbon fouling that requires an onerous cleaning process to maintain effectiveness. A suppressor can quickly become hot during use and generate a thermal signature that will give away a covert position.

There remains a need for novel firearm accessories and suppressors that provide improvements over known designs.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF DESCRIPTION OF THE DRAWINGS

A detailed description of the invention is hereafter described with specific reference being made to the drawings.

BRIEF SUMMARY OF THE INVENTION

Figure 1:
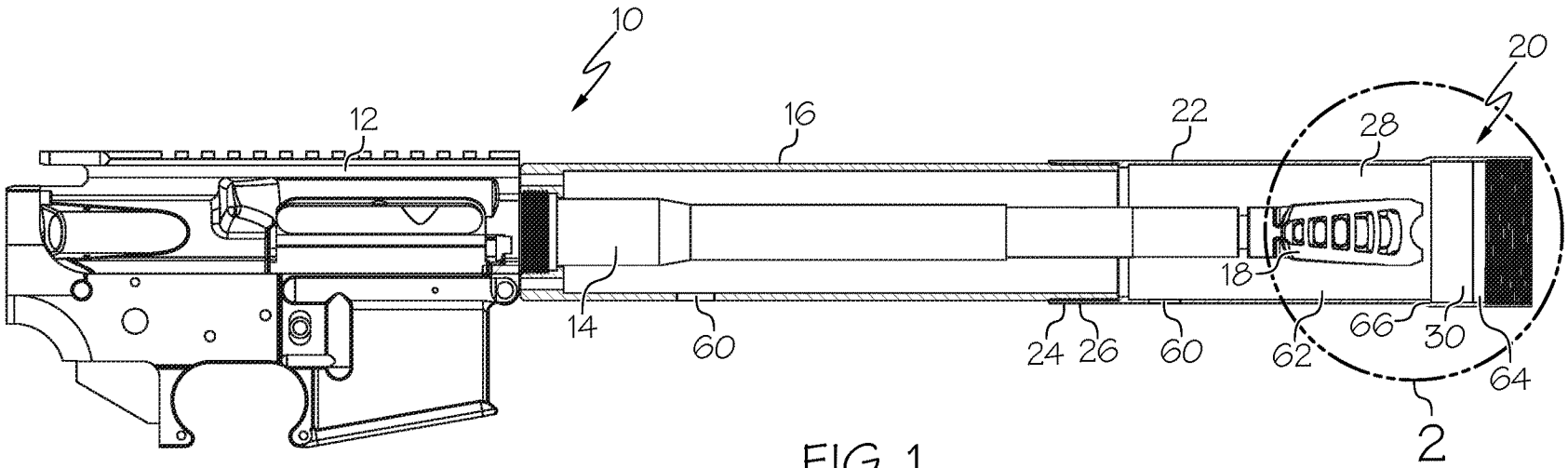
FIG. 1 shows a portion of a firearm and an embodiment of a suppressor.

In some embodiments, a firearm suppressor comprises a body comprising a sidewall defining a cavity. In some embodiments, the body is configured for attachment to a firearm such that a muzzle of the firearm barrel is oriented in the cavity. In some embodiments, the suppressor comprises a rotating member oriented in the cavity, which is arranged to rotate with respect to the body. In some embodiments, the rotating member comprises a plurality of turbine blades and a central aperture.

In some embodiments, a rotating member comprises an inner hub and an outer hub, and each turbine blade extends between the inner hub and the outer hub.

In some embodiments, a suppressor comprises a second rotating member comprising a second plurality of turbine blades. In some embodiments, first rotating member is arranged to rotate in a first direction and the second rotating member is arranged to rotate in a second direction.

In some embodiments, a firearm comprises a receiver, a barrel and a suppressor. The suppressor comprises a body defining a cavity and a rotating member oriented in the cavity. The rotating member comprises a plurality of turbine blades and a central aperture. A muzzle end of the barrel is oriented in the cavity adjacent to the rotating member.

In some embodiments, the suppressor comprises a second rotating member comprising a second plurality of turbine blades. In some embodiments, the rotating members are arranged to be rotated in opposite directions.

In some embodiments, the suppressor supported by the receiver and arranged to surround the barrel.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

DETAILED DESCRIPTION OF THE INVENTION

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Figure 2:
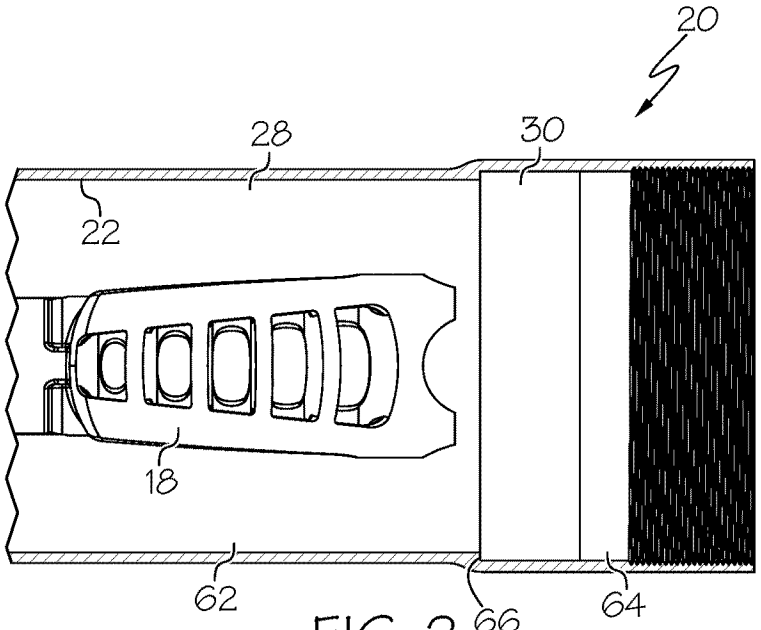
FIG. 2 shows an embodiment of a suppressor.

FIG. 1 shows an embodiment of a firearm 10 and an embodiment of a suppressor 20. FIG. 2 shows a portion of FIG. 1 in greater detail. In some embodiments, a firearm 10 comprises a receiver 12 and a barrel 14 supported by the receiver 12. In some embodiments, the firearm 10 comprises an extension member 16 that is supported by the receiver 12. In some embodiments, the extension member 16 surrounds at least a portion of the barrel 14 and comprises a barrel shroud. In some embodiments, the firearm 10 comprises a muzzle device 18 that is supported by the barrel 14, such as a flash hider, compensator or muzzle brake.

Desirably, a suppressor 20 comprises a body 22 constructed and arranged for attachment to a firearm 10. As shown in FIG. 1, the body 22 attaches to the extension member 16 and is ultimately supported by the receiver 12. In some embodiments, the body 22 comprises threads 24 arranged to engage the extension member 16. In some embodiments, the body 22 comprises a flange 26 arranged to contact the extension member 16 and function as a stop. In some embodiments, the body 22 comprises a tubular shape.

In some embodiments, the suppressor 20 does not contact the barrel 14. In some other embodiments, the body 22 is constructed and arranged for attachment to a barrel 14, for example when a firearm 10 does not include an extension member 16. Various attachment configurations for the suppressor 20 present various benefits and drawbacks to firearm performance that would be apparent to the skilled person.

In some embodiments, a suppressor 20 comprises a cavity 28. In some embodiments, at least a portion of a firearm barrel 14 and/or muzzle device 18 is oriented within the cavity 28. Desirably, the suppressor 20 comprises at least one dynamic structure 30 that is moveable with respect to the body 22. FIGS. 1 and 2 show dynamic structure 30 schematically.

In some embodiments, the dynamic structure 30 is biased into motion by expanding gasses provided by propellant as a bullet is fired from the firearm 10. In some embodiments, the dynamic structure 30 absorbs energy passively upon bullet firing as the dynamic structure 30 is biased into motion, and the energy is dissipated over time as the dynamic structure 30 slows and stops moving with respect to the body 22.

In some embodiments, the dynamic structure 30 is oriented within the cavity 28.

In some embodiments, the cavity 28 comprises a first portion 62 and a second portion 64. In some embodiments, the first portion 62 contains the firearm 10 and the second portion 64 contains the dynamic structure 30. In some embodiments, the first portion 62 is sized differently from the second portion 64. In some embodiments, the body 22 comprises a flange 66 at a transition from the first portion 62 to the second portion 64.

In some embodiments, the dynamic structure 30 is arranged to rotate. In some embodiments, the dynamic structure 30 comprises a turbine.

Figure 3:
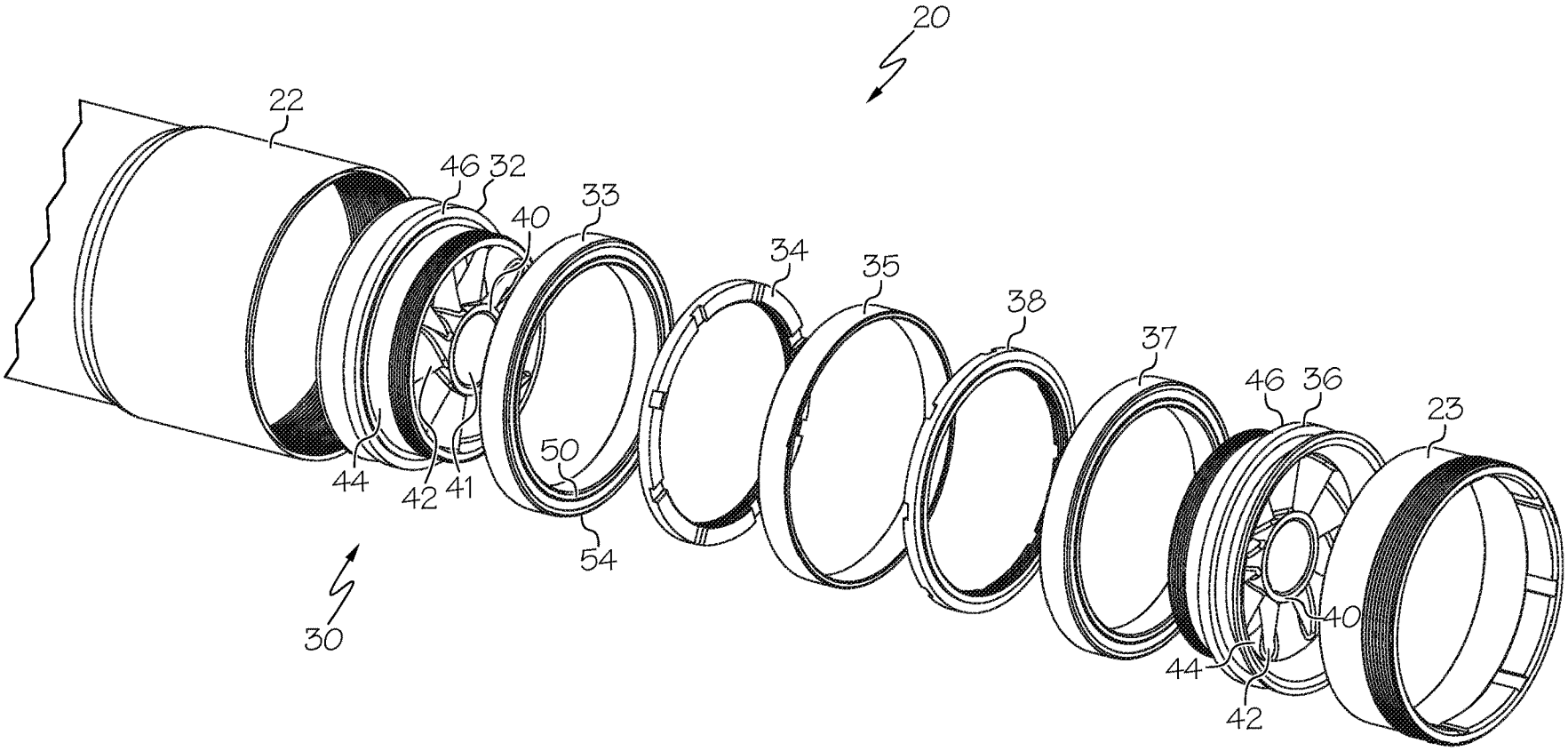
FIG. 3 shows an exploded view of an embodiment of a suppressor.
Figure 4:
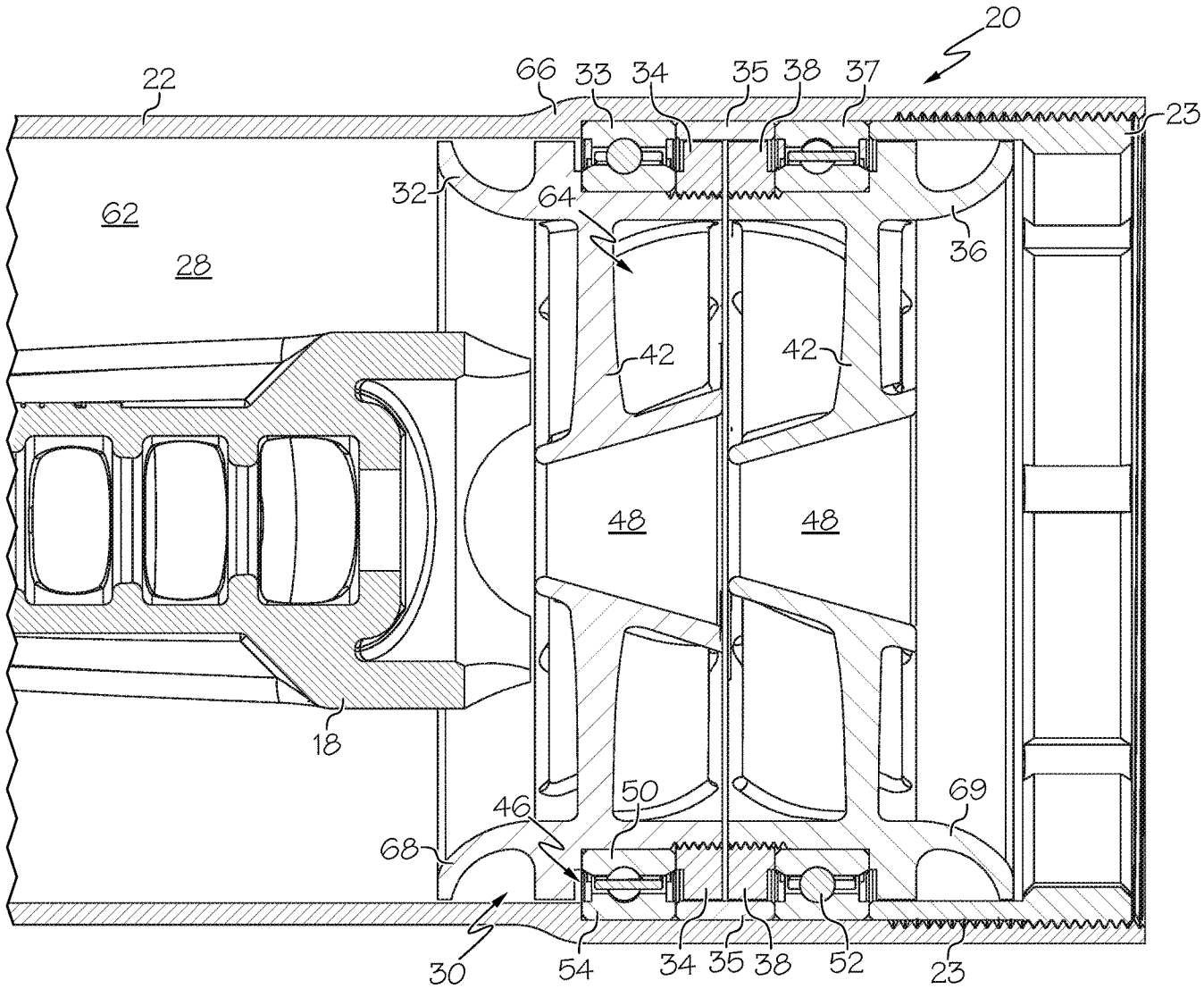
FIG. 4 shows a cross-sectional view of an embodiment of a suppressor.

FIG. 3 shows an exploded view of an embodiment of a suppressor 20. FIG. 4 shows a cross-sectional view of an embodiment of a suppressor 20.

In some embodiments, the suppressor 20 comprises a turbine member 32 or rotating member 32. In some embodiments, the turbine member 32 is received in the body 22 and arranged to rotate with respect to the body 22.

Desirably, the turbine member 32 comprises at least one blade 42. In some embodiments, a turbine member 32 comprises a plurality of blades 42. In some embodiments, the turbine member 32 comprises an inner hub 40 and an outer hub 44, and each blade 42 extends between the inner hub 40 and outer hub 44. Desirably, the turbine member 32 defines a flowpath, for example for a bullet to pass through the turbine member 32. In some embodiments, the inner hub 40 defines an aperture 41, and the aperture 41 provides the flowpath. In some embodiments, the aperture 41 is aligned on a central axis of the turbine member 32.

In some embodiments, the suppressor 20 comprises a bearing 33, for example to provide for low-friction movement of the turbine member 32 with respect to the body 22. In some embodiments, a bearing 33 comprises a rolling element bearing. In some embodiments, a bearing 33 comprises an inner race 50 that is arranged to move with respect to an outer race 54. In some embodiments, the turbine member 32 is attached to the inner race 50 and the body 22 is attached to the outer race 54.

In some embodiments, the suppressor 20 comprises a turbine fastener 34 that is used to attach the turbine member 32 to the bearing 33.

In some embodiments, the suppressor 20 comprises a second turbine member 36. In some embodiments, the second turbine member 36 comprises an inner hub 40, an outer hub 44 and blades 42, and can be similar in shape to the first turbine member 32.

In some embodiments, the second turbine member 36 is arranged to rotate in a direction that is opposite from rotation of the first turbine member 32. For example, propellant gasses passing through the body 22 can bias the first turbine member 32 to rotate in a first direction (e.g. clockwise) and can bias the second turbine member 36 to rotate in a second direction (e.g. counter-clockwise). In some embodiments, blades 42 of the first turbine member 32 are canted in a first direction and blades 42 of the second turbine member 36 are canted in a second, opposite direction.

In some embodiments, the suppressor 20 comprises a second bearing 37 and a second turbine fastener 38 associated with the second turbine 36.

In some embodiments, the suppressor 20 comprises a spacer 35 that is positioned between the first turbine member 32 assembly and the second turbine member 36 assembly.

In some embodiments, the suppressor 20 comprises a body fastener 23 that is arranged to engage the body 22 and fasten the turbine member 32, 36 assemblies in place.

Referring to FIG. 4, the engagement between the body 22 and the turbine member 32, 36 assemblies is shown in detail.

In some embodiments, a bearing 33 comprises a rolling element bearing comprising rolling elements 52. In some embodiments, a bearing 33 comprises an inner race 50 and an outer race 54.

In some embodiments, the first turbine 32 is attached to the first bearing 33 by the first turbine fastener 34. In some embodiments, the first turbine fastener 34 fastens to the first turbine 32 using helical threadings. In some embodiments, the first turbine fastener 34 and the first turbine 32 are fastened to the inner race 50 of the first bearing 33. In some embodiments, the outer race 54 of the first bearing 33 is attached to the body 22.

In some embodiments, the second turbine 36 is attached to the second bearing 37 by the second turbine fastener 38. In some embodiments, the second turbine fastener 38 fastens to the second turbine 36 using helical threadings. In some embodiments, the second turbine fastener 38 and the second turbine 36 are fastened to the inner race 50 of the second bearing 37. In some embodiments, the outer race 54 of the second bearing 37 is attached to the body 22.

In some embodiments, a spacer 35 is positioned between the turbine member 32, 36 assemblies. In some embodiments, the spacer 35 contacts the first bearing 33 and the second bearing 37. In some embodiments, the spacer 35 contacts the outer race 54 of the first bearing 33 and the outer race 54 of the second bearing 37.

In some embodiments, the turbine member 32, 36 assemblies are fastened to the body 22 by the body fastener 23. In some embodiments, the body fastener 23 engages the body 22 using helical threadings.

In some embodiments, the body fastener 23 clamps the turbine member 32, 36 assemblies against a portion of the body 22. In some embodiments, the outer race 54 of the first bearing 33 contacts a flange 66 formed in an inner sidewall of the body 22. As shown in FIG. 4, the bearings 33, 37 are attached to the body 22 by compressive forces applied to the outer race 54 of the first bearing 33 by the flange 66 and the spacer 35, and applied to the outer race 54 of the second bearing 37 by the spacer 35 and the body fastener 23.

In some embodiments, a turbine member 32, 36 comprises a central passageway 48. In some embodiments, a central passageway 48 is tapered. In some embodiments, a central passageway 48 increases in cross-sectional area as the central passageway 48 is traversed in a direction away from the barrel 14 or muzzle device 18.

In some embodiments, the first turbine member 32 and the second turbine member 36 are arranged to rotate in opposite directions. For example, expanding propellant gasses being expelled through the suppressor 20 can rotate the first turbine member 32 in a first rotational direction (e.g. clockwise) and the gasses can rotate the second turbine member 36 in a second rotational direction (e.g. counter-clockwise). In some embodiments, blades 42 of the first turbine member 32 and blades 42 of the second turbine member 36 are angled in opposite directions.

In some embodiments, a turbine member 32 comprises a shoulder 46 adjacent to a bearing 33. The shoulder 46 provides a barrier structure that helps to shield the bearing 33 from hot propellant gasses.

Referring to FIGS. 1 and 4, in operation, expanding propellant gasses will exit the barrel 14 and any muzzle device 18. Propellant gasses are delivered into the first portion 62 of the cavity 28 of the suppressor 20, and the propellant gasses may pressurize the cavity 28 and the cavity of the barrel extension 16. The propellant gasses move forward and exit the suppressor 20 through the second portion 64 of the cavity 28. As the propellant gasses pass over/through the turbine members 32, 36, the gasses drive the turbine members 32, 36 into rotational motion with respect to the body 22. Movement of the turbine members 32, 36 absorbs energy, thereby reducing recoil and noise. The energy absorbed by the turbine members 32, 36 will dissipate over time as the turbine members 32, 36 passively slow and stop rotation.

The rotation of the turbine members 32, 36 causes air movement and acts to cool components of the firearm 10, especially the barrel 14 and muzzle device 18.

In some embodiments, the body 22 of the suppressor 20 comprises an inlet 60 that allow air to be pulled into the cavity 28. In some embodiments, the inlet 60 comprises a one-way valve that allows fluid flow into the cavity 20 and prevents fluid flow out via the inlet 60. For example, during firing, the inlet 60 remains closed and contains pressure within the cavity 28 while the pressure exits the cavity 28 through the turbine member(s) 32, 36. After the pressure has been relieved, the turbine member(s) 32, 36 remain in motion, which causes a negative pressure within the cavity 28. The negative pressure pulls air into the cavity 28 through the inlet 60. Fresh air moving through the inlet 20 and through the cavity 28 helps to cool the barrel 14, muzzle device 18 and suppressor 20.

In some embodiments, an inlet 60 is located in the body 22 of the suppressor 20 near a front end of the suppressor 20. In some embodiments, an inlet 60 is located near a front end of the suppressor 20 and the turbine member(s) 32, 36 are located near the rear end of the suppressor 20.

In some embodiments, an inlet 60 is formed in the extension member 16.

Figure 5:
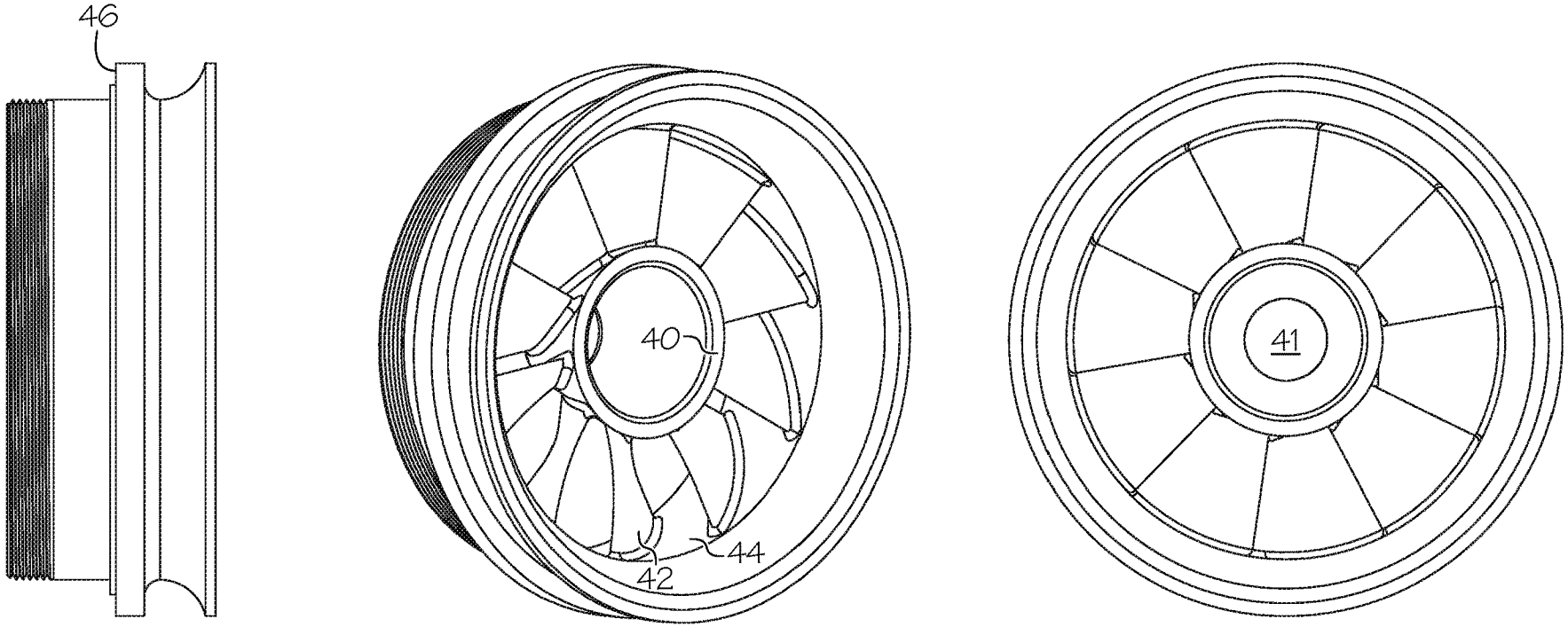
FIG. 5 shows views of an embodiment of a turbine member.

Referring to FIGS. 4 and 5, in some embodiments, a turbine member 32 comprises a shoulder flange 46 arranged to help protect a bearing 33 from propellant gasses in the suppressor 20. In some embodiments, a cavity located adjacent to the shoulder flange 46 contains the bearing 33.

In some embodiments, a turbine member 32 comprises a flared fluid inlet 68. In some embodiments, a turbine member 36 comprises a flared fluid outlet 69.

In some embodiments, a suppressor 20 as disclosed herein can be configured for attachment to the end of a gun barrel 14. For example, in some embodiments, the body 22 can be attached to a gun barrel 14 and the turbine member(s) placed in front of the gun barrel 14.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A firearm suppressor comprising:
a body configured for attachment to a firearm, the body comprising a sidewall defining a cavity;
a rotating member oriented in the cavity, the rotating member arranged to rotate with respect to the body, the rotating member comprising an inner hub, an outer hub and a plurality of turbine blades, at least one of the turbine blades attached at a first end to the inner hub and attached at a second end to the outer hub, the rotating member comprising a central aperture.

2. The firearm suppressor of claim 1, the inner hub surrounding the central aperture.

3. The firearm suppressor of claim 2, the inner hub comprising a tube comprising a central passageway, a cross-sectional area of the central passageway continuously increasing as the central passageway is traversed along its length.

4. The firearm suppressor of claim 1, comprising a bearing assembly comprising a first portion rotatable with respect to a second portion, the first portion contacting the body, the second portion contacting the rotating member.

5. The firearm suppressor of claim 4, the rotating member comprising a flange, the bearing assembly contacting the flange.

6. The firearm suppressor of claim 5, the rotating member comprising a rotating member body and a turbine fastener arranged to engage the rotating member body, the bearing assembly secured between the flange and the turbine fastener.

7. The firearm suppressor of claim 4, the body comprising a flange, the bearing assembly contacting the flange.

8. The firearm suppressor of claim 7, comprising a body fastener arranged to engage the body, the bearing assembly secured between the flange and the body fastener.

9. The firearm suppressor of claim 1, comprising a body fastener arranged to secure the rotating member in position.

10. The firearm suppressor of claim 1, the rotating member comprising a first rotating member, the plurality of turbine blades comprising a first plurality of turbine blades angled in a first direction, the suppressor comprising a second rotating member oriented in the cavity, the second rotating member arranged to rotate with respect to the body, the second rotating member comprising a second central aperture.

11. The firearm suppressor of claim 10, the second rotating member arranged to rotate in an opposite direction from the first rotating member.

12. The firearm suppressor of claim 1, the body comprising an inlet in fluid communication with the cavity.

13. The firearm suppressor of claim 1, the outer hub comprising a flared fluid outlet.

14. A firearm suppressor comprising:

a body configured for attachment to a firearm, the body comprising a sidewall defining a cavity, the body defining a flowpath;

a first rotating member oriented in the cavity, the first rotating member arranged to rotate with respect to the body, the first rotating member comprising a first plurality of turbine blades angled in a first direction, the first rotating member comprising a first central passageway, a cross-sectional area of the first central passageway continuously increasing as it is traversed in the direction of the flowpath;

a second rotating member oriented in the cavity, the second rotating member arranged to rotate with respect to the body, the second rotating member comprising a second central passageway, a cross-sectional area of the second central passageway continuously increasing as it is traversed in the direction of the flowpath, the second rotating member comprising a second plurality of turbine blades, the second plurality of turbine blades angled in a second direction different from the first direction.

15. A firearm comprising:

a receiver;

a barrel supported by the receiver, the barrel comprising a muzzle end;

a suppressor comprising a body defining a cavity, a rotating member oriented in the cavity and arranged to rotate with respect to the body, the rotating member comprising an inner hub, an outer hub, a plurality of turbine blades and a central aperture, at least one of the turbine blades attached at a first end to the inner hub and attached at a second end to the outer hub;

wherein the muzzle end is oriented in the cavity adjacent to the rotating member.

16. The firearm of claim 15, wherein a central axis of the central aperture is aligned with a longitudinal axis of the barrel.

17. The firearm of claim 15, the inner hub defining the central aperture, a cross-sectional area of the central aperture continuously increasing along its length.

18. The firearm of claim 15, the rotating member comprising a first rotating member and the plurality of blades comprising a first plurality of blades, the suppressor further comprising a second rotating member oriented in the cavity, the second rotating member comprising a second plurality of turbine blades.

19. The firearm of claim 18, the first plurality of blades swept in a first direction, the second plurality of blades swept in a second direction.

20. The firearm of claim 15, the suppressor supported by the receiver and arranged to surround the barrel.

* * * * *